US007788762B2

(12) United States Patent
Hof et al.

(10) Patent No.: US 7,788,762 B2
(45) Date of Patent: Sep. 7, 2010

(54) METHOD FOR SHAPING A ROLL CLEANING BRUSH, AND A CLEANING BRUSH SHAPED ACCORDING TO THE METHOD

(75) Inventors: Hartmut Hof, Erndtebrück (DE); Jürgen Seidel, Kreuztal (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 1201 days.

(21) Appl. No.: 10/565,225

(22) PCT Filed: Jun. 23, 2004

(86) PCT No.: PCT/EP2004/006760

§ 371 (c)(1),
(2), (4) Date: Jan. 20, 2006

(87) PCT Pub. No.: WO2005/018844

PCT Pub. Date: Mar. 3, 2005

(65) Prior Publication Data

US 2007/0033751 A1 Feb. 15, 2007

(30) Foreign Application Priority Data

Jul. 22, 2003 (DE) ..... 103 33 215

(51) Int. Cl.
*B21B 45/02* (2006.01)

(52) U.S. Cl. ..... 15/256.51; 15/102; 15/88.4; 15/256.5; 15/256.52; 72/40

(58) Field of Classification Search ..... 15/102, 15/100, 256.5, 97.1, 306.1, 308, 309.1, 309.2, 15/88.4, 256.1, 256.2; 72/40, 243.6, 241.4, 72/247, 243

See application file for complete search history.

(56) References Cited

U.S. PATENT DOCUMENTS 2,953,952 A 9/1960 Alexander
4,519,233 A * 5/1985 Feldmann et al. ..... 72/241.4

FOREIGN PATENT DOCUMENTS

EP 0394873 B1 * 4/1990
EP 0605833 B1 * 12/1993
EP 0640412 A1 * 7/1994
JP 52 092 855 8/1977
JP 09057313 A * 3/1997
JP 10034210 A * 2/1998

* cited by examiner

*Primary Examiner*—Shay L Karls
(74) *Attorney, Agent, or Firm*—Lucas & Mercanti, LLP; Klaus P. Stoffel

(57) ABSTRACT

The invention relates to a method for shaping a roll cleaning brush (1), particularly for working rolls, for use in metal and, in particular, aluminum hot strip mills, comprising a brush lining (2). The inventive brush also comprises a supporting base body (3), which is mounted at one end and which is provided with the brush covering (2) attached thereto, said brush covering being pressed against the roll (4) with a settable force or defined insertion depth in order to have a cleaning effect. In order to achieve a uniform contact pressure, the shape of the cleaning brush (1) or of the brush covering (2) is matched according to the shape of the roll (4) whereby setting, between the roll and the brush covering or cleaning brush, a contact pressure that is as uniform as possible over the entire surface length of the roll. The invention also relates to a correspondingly contoured cleaning brush (1).

10 Claims, 4 Drawing Sheets

METHOD FOR SHAPING A ROLL CLEANING BRUSH, AND A CLEANING BRUSH SHAPED ACCORDING TO THE METHOD

The application is a national stage entry of PCT/EP04/06760 filed Jun. 23, 2004.

The invention concerns a method for shaping a roll cleaning brush with a brush covering, especially for work rolls used in metal, especially aluminum, hot-rolled strip mills, which comprises a supporting base body which is supported at its ends and on which the brush covering is mounted, which brush covering is pressed against the roll with an adjustable force or a well-defined insertion depth to produce a cleaning effect. The invention also concerns a cleaning brush produced by the method of the invention and a method of operation of the cleaning brush.

In aluminum hot-rolled strip mills, it is necessary to clean at least the work rolls during the rolling process. For this purpose, rotating brushes are pressed against the work rolls to keep the rolls clean of emulsion residues, coatings of oxide particles and particles of rolling stock material, etc. This cleaning of the work rolls is essential for ensuring a satisfactory, uniform surface quality of the rolled strip.

The type of brush that is often used is the steel brush. The coverings of these brushes are relatively stiff and therefore can adapt to the contours of the rolls only very incompletely.

The steel brush consists of a supporting base body and a brush covering mounted on it, the so-called lining. This consists of brush bristles of corrugated steel wires. To achieve a cleaning effect, the brush is pressed against the roll with a certain force or with a well-defined lowering depth of the steel wires. Naturally, this causes the brush to experience a bending deflection under the load. When a cylindrical work roll and a cylindrical brush are used, a contact pressure is developed, which is higher in the marginal areas and lower in the center due to the bending deflection of the brush.

However, if special cross sections, especially of the work rolls, have been provided, when the brush is pressed against the roll, it is first necessary to overcome a gap between the work roll and the steel brush before the brush can make contact along the entire length of the work roll. However, the resulting contact pressure is necessarily nonuniform. In areas of relatively high contact pressure, the brush bristles can be subject to greater wear. In areas of lower contact pressure, on the other hand, a less intense local cleaning effect may be expected, or there may be no contact at all. In any event, the conditions over the body length of the roll and the action time are not uniform, which is a disadvantage with respect to surface quality in the rolling of many aluminum alloys and other nonferrous metals, for with increasing adjusting range of contoured rolls and the associated greater differences in diameter over the body length of the work rolls, the problem or the nonuniformity increases considerably.

An important goal in the hot rolling and cold rolling of strip is to produce a crown that fully satisfies the requirements on the rolled product and at the same time to achieve good strip flatness. However, the strip crown is affected by many factors, such as thermal crown, roll wear, and rolling forces. Therefore, one of the things that must be done is to continuously adapt the crown of the work rolls. A roll with a continuously variable crown has been found to be the most suitable adjustment mechanism for this purpose. In this regard, the work rolls are ground, for example, approximately with an S shape. The two work rolls have an identical cross section: The cross section of the upper roll is displaced by 180° relative to the lower roll, so that they complement each other and produce a symmetrical roll gap contour.

The document EP 0 605 833 B1 discloses a device for adjusting a brush roll, especially relative to the work roll of a rolling stand for the hot rolling of aluminum, wherein the brush roll is supported at both ends in pivoted supports, can be rotated in the opposite direction from the direction of rotation of the work roll, and can be displaced in a translational movement parallel to the work roll. The pivot bearing of each brush roll support is installed on the chock of the work roll. The support has a pivoting lever which is located between a controllable actuating element and a restoring support element. The actuating element is mounted in the balancing block or bending block for the work rolls, and the support element is mounted on the work roll chock.

The document EP 0 394 873 B1 describes a method for cold rolling aluminum strip in a rolling mill, which has at least one pair of work rolls and one pair of backup rolls, wherein each backup roll is arranged to make contact with one work roll. A cleaning brush is provided for each backup roll and is positioned at the open end of a suction duct to make contact with and brush the backup roll. The method is defined by the following steps:

rotation of the brush in a direction opposite the direction of rotation of the backup roll;

suction of air into the open end of the suction duct, such that the suction flow rate of the air is at least 5 m/s, and such that the suction duct is provided with suction control means and with a mechanism for advancing and returning;

adjustment of the positions of the suction control means to maintain the open end of the suction duct at a predetermined distance from the backup roll.

The document EP 0 640 412 A1 describes a device for cleaning and polishing a roll, which comprises a cleaning roll, which is rotatably supported on a support member with two parallel arms, which extend between an inner end and an outer end and can move between a position in contact with the cleaning roll and a clearance position, as well as means for controlling the rotation. The outer ends of the two support arms are supported parallel to the axis of the roll on two aligned fixed bearings, respectively, wherein the rotating roll is driven by a kinematic chain that turns on the shaft of the transmission.

The document JP 9057313 A is concerned with the problem of deterioration of the surface quality of a rolled plate and the problem of roll coating during the rolling of aluminum plates. To solve these problems, the invention proposes that brush rolls be assigned to the work rolls in a cold-rolling stand and that they make contact with the work rolls for the purpose of removing the coating that adheres to the surfaces of the work rolls.

The document JP 10034210 A is concerned with the problem of preventing slag particles from forming a coating on work rolls. To solve this problem, the invention proposes that a brush roll be installed for cleaning each work roll. For this purpose, the brush roll has a hollow space for the passage of liquid coolant and radially arranged holes for its discharge from the hollow space.

Proceeding from the prior art described above, the objective of the present invention is to design or grind a cleaning brush in such a way that a uniform contact pressure develops between, for example, a work roll and the cleaning brush over the body length of the roll for a work roll body shape that is contoured in any given way.

In accordance with the present invention, this objective is achieved by a method for shaping a cleaning brush, especially a cleaning brush for cleaning work rolls used in metal, especially aluminum, hot-rolled strip mills, wherein the shape of the cleaning brush or the brush covering is matched to the shape of the roll in such a way that a contact pressure between the roll and the cleaning brush that is as uniform as possible is established over the entire body length of the roll and especially in the region of the strip width of the roll.

One embodiment of the method provides that the shape of the cleaning brush or the brush covering is so extensively matched to the shape of the roll that minimal contact force can be set to achieve a sufficient cleaning effect.

In another embodiment, use can be made of the measure that the shape of the brush covering or of the cleaning brush is formed according to the particular geometry of the roll, for example, with a parabolic cross section, with a cross section based on the mathematical function of a particular polynomial, an exponential function, a trigonometric function, etc.

The method is advantageously further characterized by the fact that the empirically known bending deflection of the base body of the brush and the empirically known thermal crown of the roll are compensated by a conformal symmetrical camber of the brush covering, taking into account the effect of the rigidity of the base body of the brush.

Finally, the method of the invention provides that, if the work roll is axially displaced during the operation by a functionally related measure of length, the cleaning brush is also displaced by a preferably equal measure of length in the same direction in order to maintain its relative longitudinal position to the roll and to the shape of the roll. In the case of stationary brushes, the contact pressure would have to be adjusted.

It is advantageous for a cleaning brush with a brush covering of the invention for use in metal, especially aluminum, hot-rolled strip mills, especially for carrying out the method of the invention, to be given a contour of its brush covering which matches the contour of the rolls, especially the work rolls.

Finally, the cleaning brush of the invention is designed in such a way that it is provided, at at least one of its terminal bearings, with means for displacing it in its axial direction or is coupled with the displaceable work rolls.

Additional modifications of the cleaning brush are specified in the dependent claims.

Details, features and advantages of the invention are revealed in the following explanation of a specific embodiment of the invention, which is illustrated schematically in the drawings.

Figure 2:
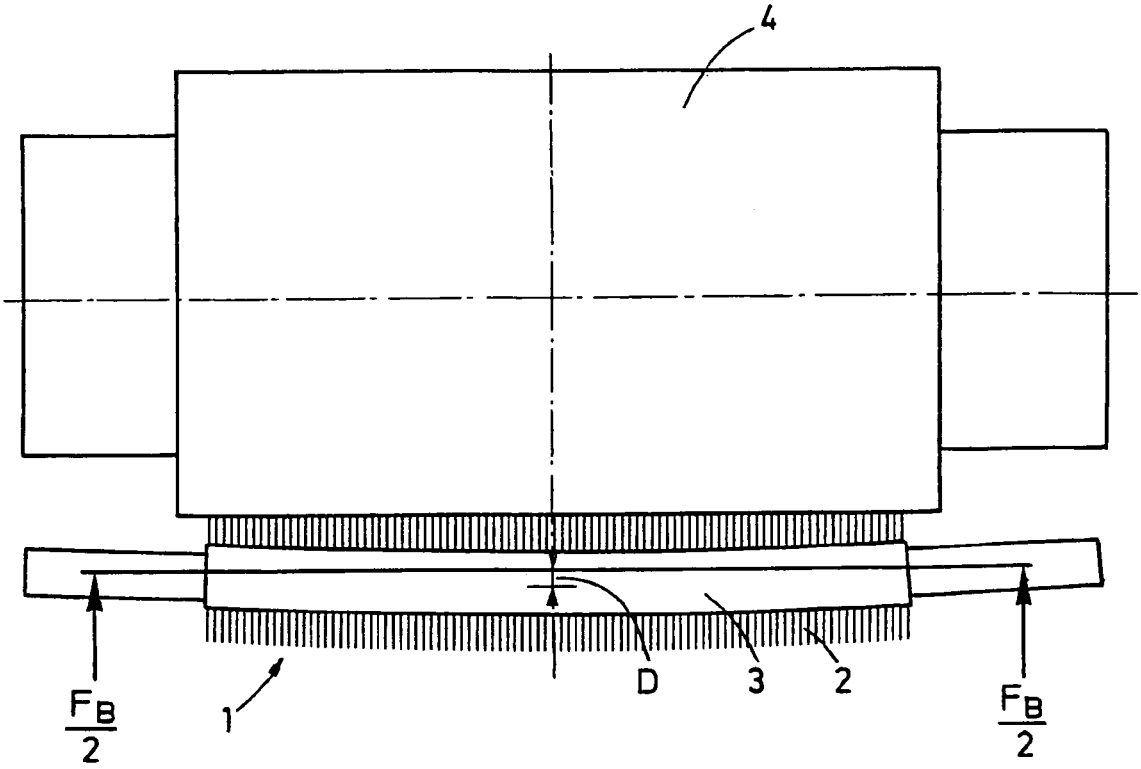
FIG. 2 shows the bending deflection of a cylindrical cleaning brush when used in interaction with a cylindrical work roll.
Figure 2A:
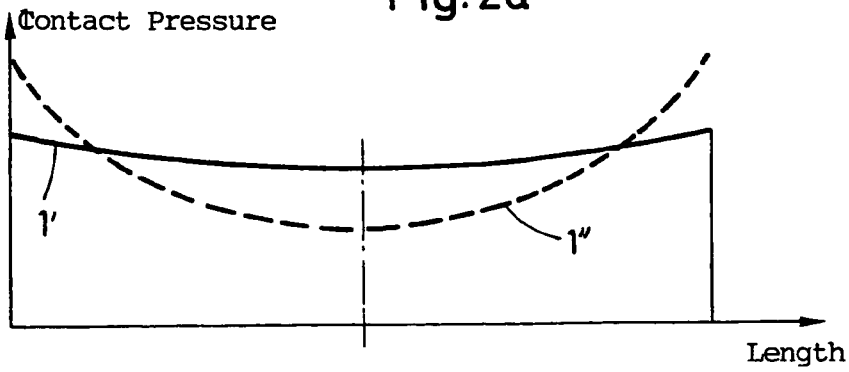

FIG. 2*a* shows a diagram of the contact pressure of the cleaning brush of FIG. 2.

Figure 3:
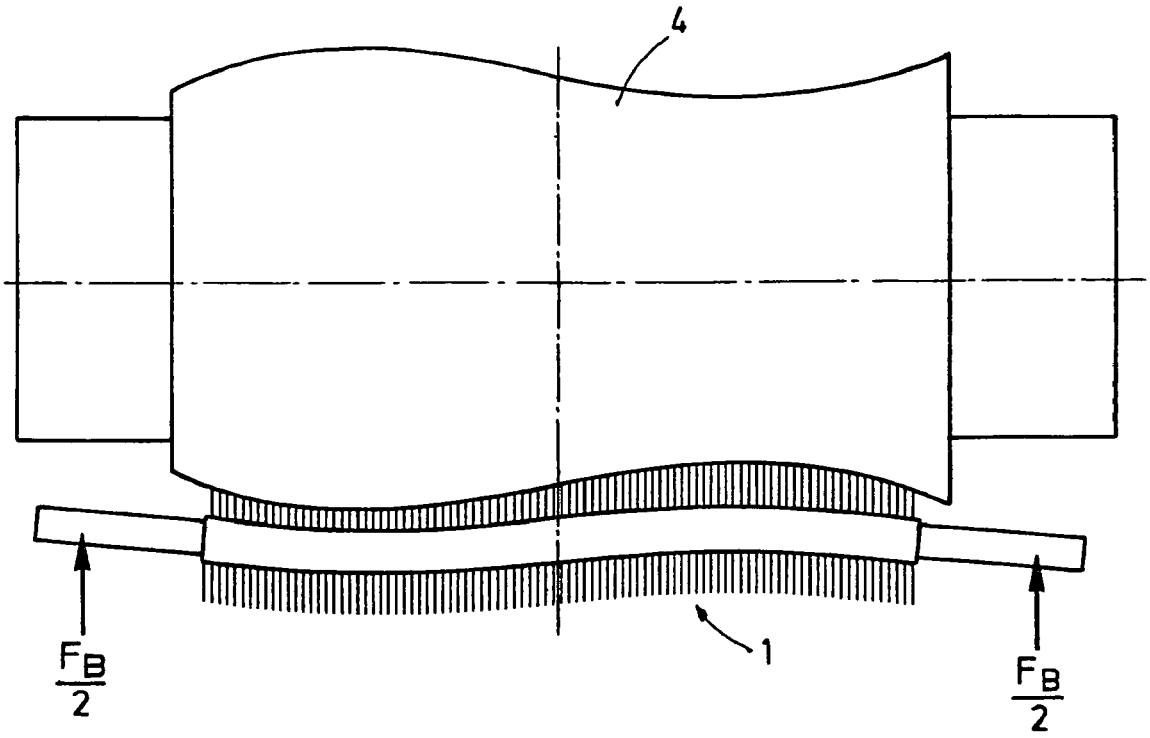

FIG. 3 shows the varying intensity of the contact pressure between work roll and cleaning brush when an S-contoured work roll interacts with a cylindrical brush.

Figure 3A:
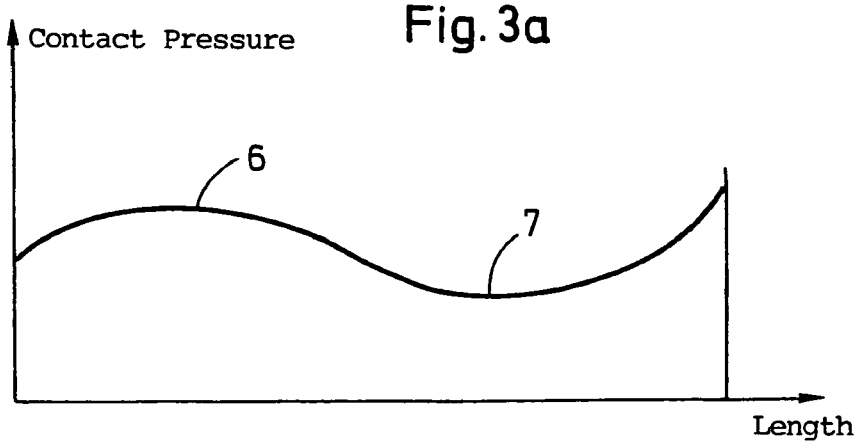

FIG. 3*a* shows the region of greater brush wear in accordance with FIG. 3.

Figure 4:
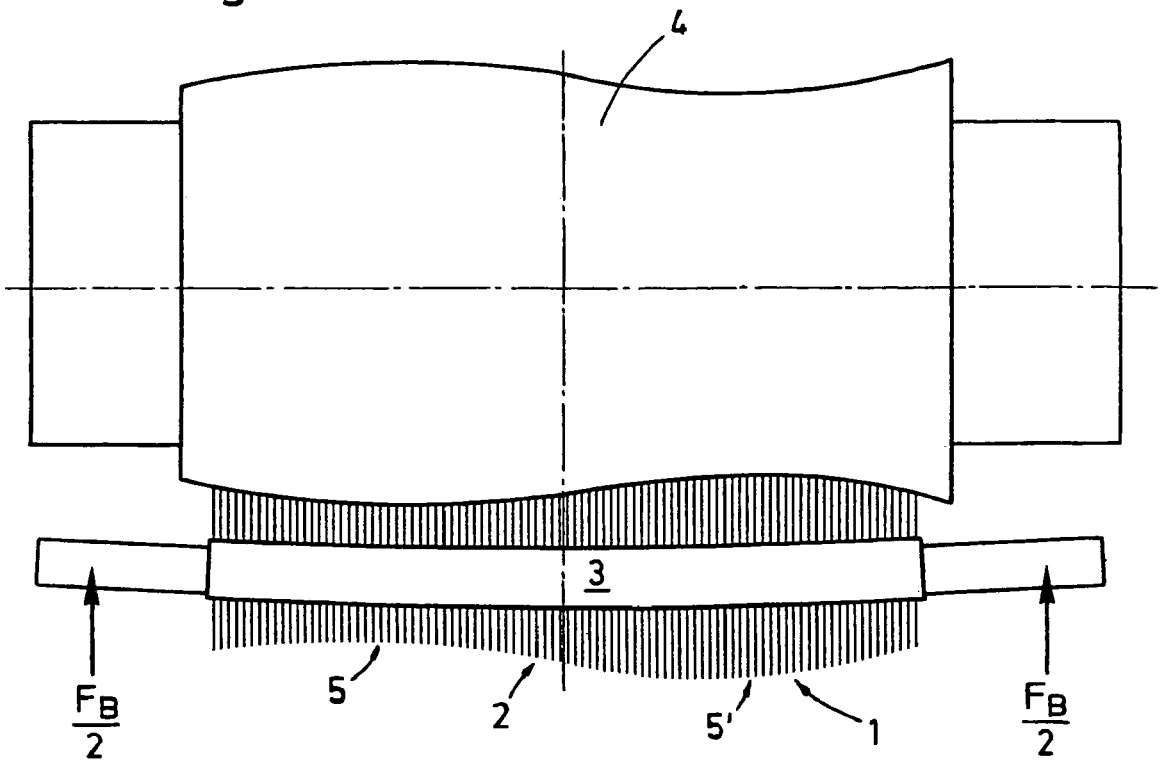

FIG. 4 shows a work roll and cleaning brush in the case of a work roll and cleaning brush with an S-shaped contour formed on both sides.

Figure 4A:
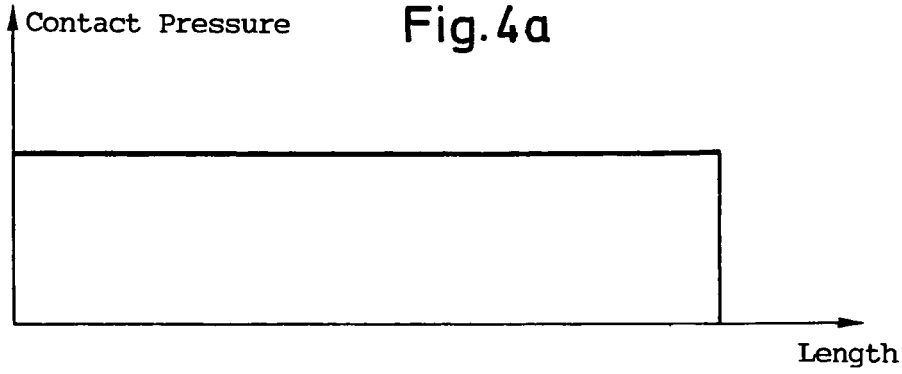

FIG. 4*a* shows a diagram of the development of operating pressure in accordance with FIG. 4.

Figure 1:
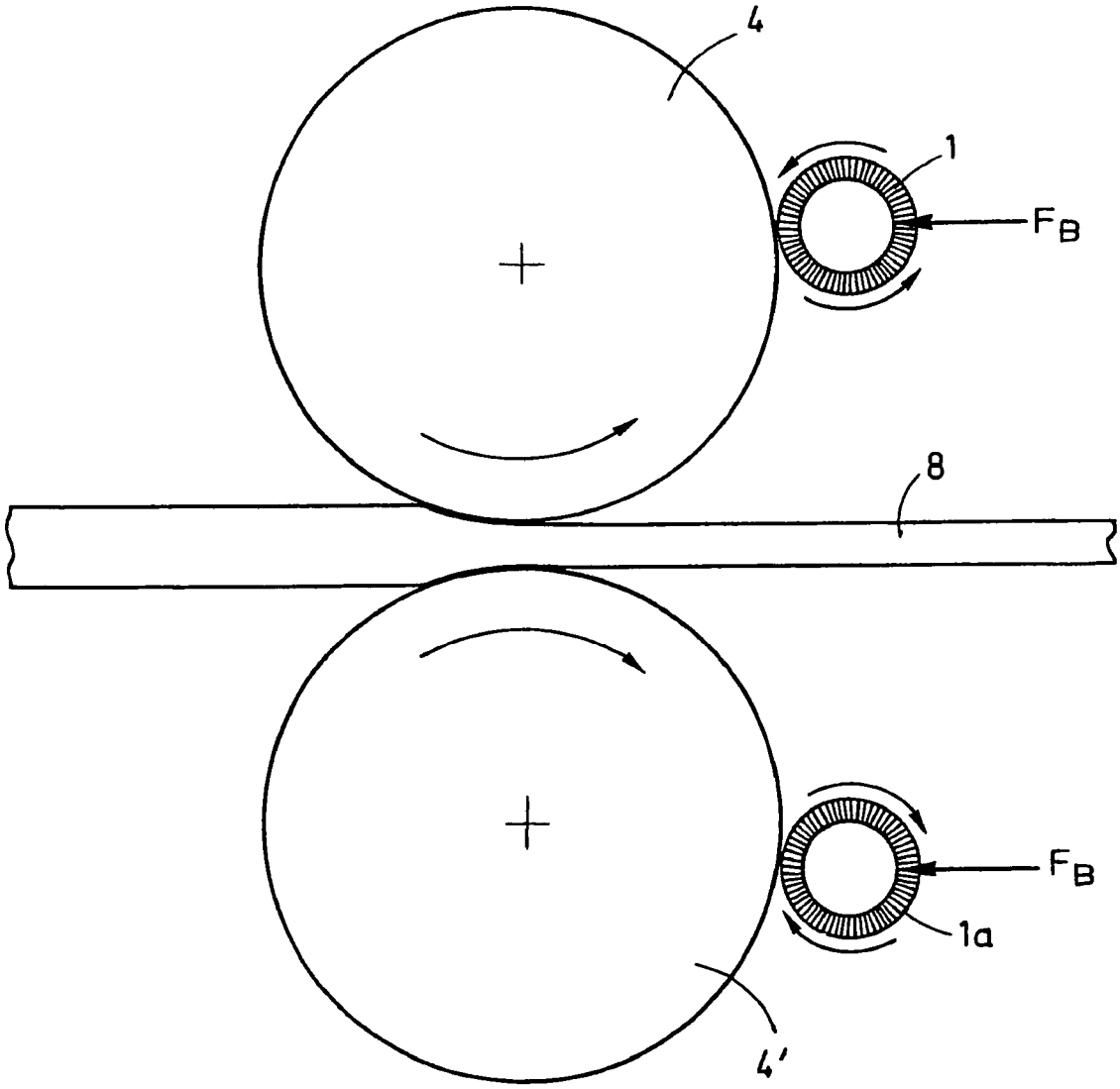
FIG. 1 shows a front-face view of two cylindrical work rolls in interaction with cylindrical cleaning brushes.

FIG. 1 shows a pair of work rolls 4, 4' during the rolling of a rolled strip 8 in the roll gap. The surface areas of the work rolls 4, 4' emerging from the roll gap 8 are engaged by the oppositely rotating cleaning brushes 1, 1*a*, which clean them of contaminants, such as emulsion residues and coatings of oxide particles and particles of rolling stock material. The drawing shows the front faces of the work rolls 4, 4' and of the cleaning brushes 1, 1*a*. The work rolls and cleaning brushes are cylindrically shaped.

FIG. 2 shows a side view of the work roll 4 in interaction with the cylindrical cleaning brush 1. The cleaning brush is pressed at both ends against the work roll 4 with contact forces $F_B/2$, and this results in the development of a bending deflection D. As FIG. 2 further shows, the cleaning brush comprises a base body 3, which is preferably made of steel, with a brush covering 2, which consists of corrugated steel wires.

FIG. 2*a* shows a diagram of the bending deflection due to variable contact pressure between the work roll 4 and the cleaning brush 1, in which the deflection of a soft brush 1' is compared with that of a hard brush, especially a steel wire brush 1".

The diagram in FIG. 3*a* shows the region 6 of increased contact pressure and the adjacent region 7 of lower contact pressure and correspondingly lower cleaning effect when a work roll 4 with an S-shaped contour is combined with a cylindrical cleaning brush 1. A combination of this type is obviously ineffective.

The diagram in FIG. 4*a*, on the other hand, shows uniform contact pressure over the length of the cleaning brush 1.

In accordance with the invention, optimum contact pressure of this type is achieved when a work roll 4 is shaped with an S-shaped contour and interacts with a cleaning brush 1 with an S-shaped contour. In this regard, the shape of the brush cross section 5, 5' is so extensively matched to the shape of the work roll 4 that a minimal contact force $F_B$ can be selected to achieve a sufficient cleaning effect. The shape of the brush covering 2 is selectively formed according to the particular geometry of the roll 4, i.e., with a parabolic cross section, with a cross section based on a particular polynomial, an exponential function, a trigonometric function, etc.

In this connection, it is especially advantageous that the empirically known bending deflection D of the base body 3 of the brush and the empirically known thermal crown of the work roll 4 are compensated by a conformal symmetrical camber of the brush covering 2, taking into account the effect of the rigidity of the base body 3 of the brush.

If the work roll 4 is axially displaced during the operation by a functionally related measure of length, the cleaning brush is also displaced by a preferably equal measure of length in the same direction in order to maintain its relative longitudinal position to the roll and to the shape of the roll, and/or the contact pressure of the brush is varied. For use in metal, especially aluminum, hot-rolled strip mills, the cleaning brush is provided with a brush covering 2 made of corrugated steel wires.

Since the contour of the cleaning brush conforms from the start to the contour of the work roll, and this conformation is present in every axially displaced position of the work roll, largely uniform contact pressure and thus optimum cleaning of the work roll are ensured.

The invention claimed is:

1. Method for shaping a roll cleaning brush (1) for work rolls, comprising the steps of: providing a supporting base body (3) which is supported at its ends; mounting a brush covering (2) made of wires onto the base body, pressing the brush covering (2) against the work roll (4) with an adjustable force or a well-defined insertion depth to produce a cleaning effect; forming the shape of the brush covering (2) or of the cleaning brush (1) according to the geometry of the work roll (4) with a contour based on the mathematical function of a polynomial, an exponential function, or a trigonometric function.

2. Cleaning brush with a brush covering (2) for use in metal, especially aluminum, hot-rolled strip mills, which is produced in accordance with claim 1, wherein the cleaning brush or its brush covering (2) has a contour which matches the contour of the work rolls (4), and that it has the contour of a given polynomial, an exponential function, or a trigonometric function.

3. Cleaning brush in accordance with claim 2, and further comprising means for displacing the cleaning brush, the displacing means being arranged at least one terminal bearing of the brush.

4. Cleaning brush in accordance with claim 3, wherein the means for displacing the cleaning brush are coupled, preferably in a synchronized way, with the means for displacing the work roll.

5. Cleaning brush in accordance with claim 3, wherein the cleaning brush is provided, at least one of its terminal bearings, with means for displacing the cleaning brush in its axial direction or is coupled with the displaceable work rolls.

6. Cleaning brush in accordance with claim 5, wherein the means for displacing the cleaning brush are coupled, preferably in a synchronized way, with the means for displacing the work roll.

7. Method of operation of a cleaning brush with a brush covering (2) in metal, especially aluminum, hot-rolled strip mills, which is produced in accordance with claim 1, wherein the shape of the brush covering (2) or the shape of the cleaning brush (1) is so extensively matched to the shape of the work roll (4) that a largely uniform contact pressure between the work roll and the brush covering or cleaning brush is established over the body length of the work roll, preferably in the region of a strip width of the work roll, with a minimal contact force $F_B$ for a sufficient cleaning effect.

8. Method in accordance with claim 7, wherein an empirically known bending deflection of the base body (3) of the brush and an empirically known thermal crown of the work roll (4) are compensated by a conformal symmetrical camber of the brush covering (2), taking into account the effect of the rigidity of the base body (3) of the brush.

9. Method in accordance with claim 7, wherein if the work roll (4) is axially displaced during the operation by a functionally related measure of length, the cleaning brush (1) is also displaced by a preferably equal measure of length in the same direction in order to maintain its relative longitudinal position to the work roll and to the shape of the work roll.

10. Method in accordance with claim 7, wherein if the work roll (4) is axially displaced, the contact pressure of the brush is adjusted to the altered effective work roll geometry.

* * * * *